United States Patent [19]

Aoyama

[11] 4,442,555

[45] Apr. 17, 1984

[54] TOILET BOWL ODOR REMOVAL SUCTION CONTROL

[76] Inventor: Yoshitaka Aoyama, 20-11 Makitsukadai 2-chome, Sakai-shi, Osaka 590-01, Japan

[21] Appl. No.: 269,973

[22] Filed: Jun. 3, 1981

[30] Foreign Application Priority Data

Jul. 6, 1980 [JP] Japan ..... 55-76812

[51] Int. Cl.[3] ..... E03D 9/05

[52] U.S. Cl. ..... 4/213

[58] Field of Search ..... 4/209 R, 213, 216, 218

[56] References Cited

U.S. PATENT DOCUMENTS 2,778,033 1/1957 Majauskas ..... 4/213
2,949,615 8/1960 Farrell ..... 4/216
3,192,539 7/1965 Martz ..... 4/213 X
3,626,554 12/1971 Martz ..... 4/213
4,318,192 3/1982 Williams et al. ..... 4/216 X

FOREIGN PATENT DOCUMENTS 260462 7/1965 Australia ..... 4/213

*Primary Examiner*—Phillips Charles E.
*Attorney, Agent, or Firm*—Armstrong, Nikaido, Marmelstein & Kubovcik

[57] ABSTRACT

A toilet bowl deodorizing device of the type including an odor exhaust passageway connected to a flush passageway extending from a flush tank to a toilet bowl, and a suction fan installed in the exhaust passageway. The device comprises a ventilation control unit installed at an opening in an overflow passageway provided in the flush tank and communicating with the flush passageway, whereby odor removal suction is properly controlled.

3 Claims, 6 Drawing Figures

TOILET BOWL ODOR REMOVAL SUCTION CONTROL

Figure 1:
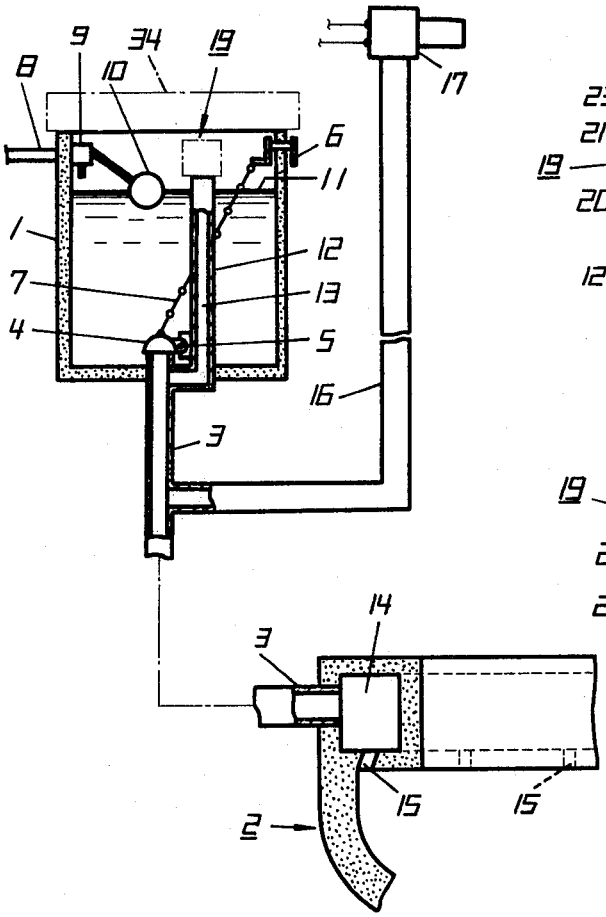

The present invention relates to a device for removing the bad odor inside a toilet bowl.

It is known to forcedly suck the excretal ordor before the latter starts to diffuse from and within the toilet bowl, so as to prevent the odor from hanging in the air in the toilet. In one type comprising an odor exhaust passageway connected to a flush passageway extending from a flush tank to a toilet bowl, and a suction fan installed in the exhaust passageway, besides an air current carrying the odor with it and moving through the opening in the flush passageway of the toilet bowl and into the suction fan, there is another air current coming in through the opening in the overflow passageway of the flush tank and moving into the suction fan. Generally, the flow resistance imposed on the former air current is greater than that on the latter air current, so that there is a problem that a larger amount of air flows in through the overflow passageway, which offers less flow resistance, thereby decreasing the suction effect. In this case, the use of a suction fan of higher capacity would be effective, but this is not desirable from the standpoint of fan cost power consumption.

With the above-described ventilation phenomena in mind, the invention has originated in an idea for applying ventilation control means to the overflow passageway but is also intended to adapt such means for seasonal changes in atmospheric temperature and for the user's liking. More particularly, in the system for forced removal of odor, the air current touches the human body, causing the problem of making the user feel cold in cold weather. When this is considered from the standpoint of summer and winter times, it is seen that when the temperature and humidity are high as in summer time, it is preferable to provide an increased amount of air current touching the human body for the purpose of positive prevention of order diffusion and for consideration of perspiration, and that in winter time, where the conditions are opposite to those in summer time, it follows that it is proper to decrease the amount of air current as compared with summer time so as to cope with the problem of coldness.

The present invention contemplates improving a device for removing the bad odor inside a toilet bowl during the time the user is easing nature. More particularly, the invention makes effective use of the overflow passageway provided in the flush tank, thereby properly controlling odor removal suction so as to suit changes in atmospheric temperature and also suit the user's liking and bring about satisfactory results with efficient use of a suction fan.

According to the invention, ventilation control means is provided in the opening in the overflow passageway, whereby ventilation from the overflow passageway is allowed or cut off so as to enable the odor removal suction state to be set to two stages, strong and weak, or the ventilation is cut off or adjusted to a suitable value. Therefore, the air current produced along with odor removal suction and flowing by the human body can be properly adjusted to suit the seasonal temperature and humidity or the user's liking. Further, completely closing or choking the opening in the overflow passageway allows the use of a suction fan having as low a suction capacity as possible, which is effective in cost saving and size reduction of the suction fan.

Figure 2:
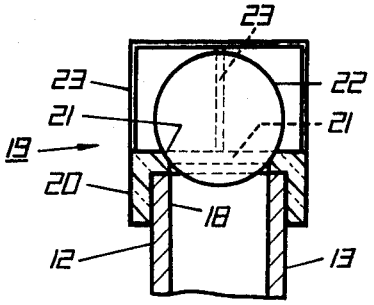
Figure 3:
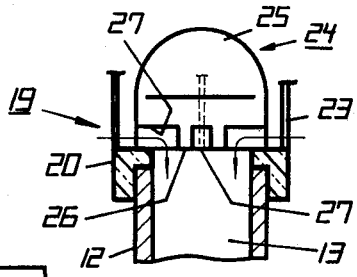
Figure 4:
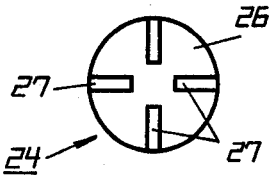

These and other objects and features of the invention will become more apparent from the following description when taken in conjunction with the accompanying drawings in which:

FIG. 1 shows an overall piping system of a water closet to which the invention is applied; and FIGS. 2 et seq show examples of ventilation control means embodying the invention, of which FIGS. 2, 3, 5, and 6 are longitudinal sectional views with FIG. 4 being a bottom view of a valve body shown in FIG. 3.

In FIG. 1, a flush tank 1 and a toilet bowl 2 are connected together by a flush pipe 3 and an on-off valve 4 is seated on the end of the flush pipe 3 in the vicinity of the bottom of the flush tank 1. The on-off valve 4 is pivotally connected to a suitable stationary member by a pin 5 and is connected to an operating lever 6 by a chain 7. A float valve 9 is installed at the front end of a water service pipe 8, and the level of the float 10 thereof suitably determines the water level 11. It is so arranged that if the water level 11 abnormally rises owing to some failure or other, the excess of water is drained through an overflow pipe 12. The pipe 12, which forms an overflow passageway 13, is connected to the pipe 3 at a place downstream of the place where the on-off valve 4 is seated, so that the flush water which is overflowing flows down the pipes 12 and 3 into the bowl 2.

The toilet bowl 2 may be of Japanese or western style and is formed with a hollow portion 14 in the upper edge thereof which, in turn, is formed with a number of openings 15. The flush passageway which extends from the flush tank 1 to the toilet bowl 2 is defined by the flush pipe 3 and hollow portion 14, and an exhaust pipe 16 is connected somewhere to the passageway to form an exhaust passageway. The end of the exhaust pipe 16 opens to the outside of the toilet, and a suction fan 17 is connected somewhere to the pipe. The fan 17 may be a conventional electrically powered one and is associated with an electrical switch (not shown) installed in a handy place in the toilet.

Turning the operating lever 6 to open the on-off valve 4 allows the flush water to flow down the flush passageway into the toilet bowl 2 to wash away the excreta. If the suction fan 17 is operated when the on-off valve 4 is closed, the bad odor tending to diffuse outside the toilet bowl 2 is removed through the hollow portion 14, flush pipe 3 and exhaust pipe 16. In this case, air is sucked also through the overflow pipe 12 and finally discharged along with the odor. The objects of the invention described above are realized by applying control to this air current.

More particularly, ventilation control means 19 is installed at the opening 18 in the overflow passageway 13. In FIG. 1, the means 19 is schematically shown in phantom lines. In an example shown in FIG. 2, an annular valve seat body 20 is fitted in the upper end of the pipe 12 and a ball valve 22 is seated on the valve seat body 20, with a cage-like frame 23 being fixed to the valve seat body 20 to prevent the ball valve 22 from falling. When the ball valve 22 is closed as shown, the total amount of air sucked by the suction fan 17 is inhaled through the openings 15, so that the amount and flow rate of air current coming in the toilet bowl increase, presenting a situation which suits summer time, as described above. Further, removal of the ball valve 22 allows air to flow in through the overflow passageway 13, thus decreasing the amount of suction air from the openings 15, presenting a situation which suits winter time, as described above.

An embodiment shown in FIGS. 3 and 4 is a modification of the ball valve 22. This valve body 24 has a spherical portion 25 and a flat seat surface 26, which is provided with ventilation grooves 27. In FIG. 3, the seat surface 26 is placed on the valve seat body 20, and when the suction fan 17 is operating, air flows in as indicated by arrows, so that the amount of suction air from the openings 15 decreases, providing a situation suitable for winter time. If the valve body 24 is turned over to seat the spherical portion 25 on the valve seat body 20, the total amount of suction air provided by the suction fan 17 is inhaled through the openings 15, bringing about a situation suitable for summer time. The difference between the embodiment shown in FIG. 2 and the embodiment shown in FIGS. 3 and 4 is that in the case of FIG. 2 embodiment either a completely opened or closed state is established whereas in the case of FIGS. 3 and 4 the spherical portion 25 establishes a completely closed state or the ventilation grooves 27 controls the amount of ventilation so that desired suction at the openings 15 can be attained by suitably adjusting the channel area of the ventilation grooves 27.

In addition, the ball valve 22 and valve body 24 are hollowed out or made of lightweight material so that if the water level 11 becomes abnormally high, they float up to allow the excess of water to flow down the overflow passageway 13 into the toilet bowl 2.

Figure 5:
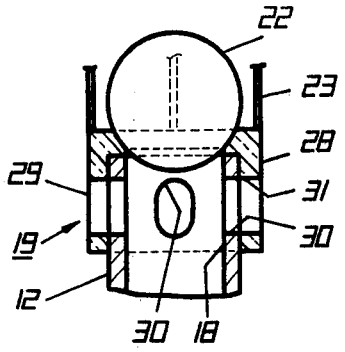

An embodiment shown in FIG. 5 uses a ball valve 22 similar to the one used in FIG. 2, but the method of ventilation control used is of a rotatinal adjustment type. More particularly, a cylindrical valve seat body 28 is mounted on the upper end of the overflow pipe 12, with its cylindrical portion 29 being snugly fitted for rotation on the upper end of the pipe 12, so that when ventilation holes 30 and 31 formed in the pipe 12 and cylindrical portion 29, respectively, are aligned with each other, as shown, the maximum inflow state is established, while the completely closed state and intermediate states can be obtained by staggering these holes in varied degrees.

Figure 6:
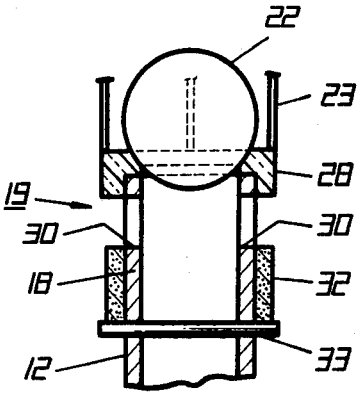

In an embodiment shown in FIG. 6, the effective ventilation area of ventilation holes 30 is suitably varied by vertically shifting a cylindrical member 32 which is separate from a valve seat body 28, and a pin 33 passing through the pipe 12 serves as a stop for the cylindrical member 32. In addition, the numeral 34 in FIG. 1 denotes a lid, which will be removed when the ventilation control means 19 is handled.

While certain present preferred embodiments have been described, such description is for illustration purposes only, and it is to be understood that changes and variations may be made without departing from the spirit or scope of the following claims.

What is claimed is:

1. A toilet bowl odor removal suction control device for use with a water closet having a flush passageway leading from a flush tank to a toilet bowl, an overflow pipe in said flush tank extending above the water line and in communication with said flush passageway, said device being characterized in that an exhaust passageway is connected to said flush passageway, a suction fan is installed in said exhaust passageway, and a ventilation control means is installed in an opening of said overflow pipe, said ventilation control means comprising an annular valve seat fitted on the upper end of said overflow pipe and a ball valve seatable on said valve seat, said annular valve seat is turnable relative to said overflow pipe and has a plurality of holes in the peripheral wall thereof, and said overflow pipe is formed with holes cooperating with said holes in said valve seat to form ventilation holes whose area of opening is variable.

2. A toilet bowl odor removal suction control device for use with a water closet having a flush passageway leading from a flush tank to a toilet bowl, an overflow pipe in said flush tank extending above the water line and in communication with said flush passageway, said device being characterized in that an exhaust passageway is connected to said flush passageway, a suction fan is installed in said exhaust passageway, and a ventilation control means is installed in an opening of said overflow pipe, said ventilation control means comprising an annular valve seat fitted on the upper portion of said overflow pipe and a ball valve seatable on said valve seat, said overflow pipe is formed with a plurality of ventilation holes, and a cylindrical member capable of varying the area of opening of said ventilation holes is fitted over said overflow pipe.

3. A toilet bowl odor removal suction control device for use with a water closet having a flush passageway leading from a flush tank to a toilet bowl, an overflow pipe in said flush tank extending above the water line and in communication with said flush passageway, said device being characterized in that an exhaust passageway is connected to said passageway, a suction fan is installed in said exhaust passageway, and a ventilation control means is installed in an opening of said overflow pipe, said ventilation control means comprising an annular valve seat fitted on the upper end of said overflow pipe, and a substantially semispherical valve body, said semispherical valve body having a semispherical portion seated on said valve seat to cut off ventilation and a flat surface having ventilation grooves for allowing ventilation when seated on said valve seat.

* * * * *